US009120315B2

(12) United States Patent
Katoh

(10) Patent No.: US 9,120,315 B2
(45) Date of Patent: Sep. 1, 2015

(54) DROPLET EJECTION DEVICE AND IMAGE FORMING APPARATUS INCLUDING THE DROPLET EJECTION DEVICE

(71) Applicant: Tomomi Katoh, Kanagawa (JP)

(72) Inventor: Tomomi Katoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 29 days.

(21) Appl. No.: 13/937,301

(22) Filed: Jul. 9, 2013

(65) Prior Publication Data

US 2014/0015896 A1 Jan. 16, 2014

(30) Foreign Application Priority Data

Jul. 10, 2012 (JP) ..... 2012-154329

(51) Int. Cl.
*B41J 2/165* (2006.01)

(52) U.S. Cl.
CPC ..... *B41J 2/16523* (2013.01); *B41J 2/16508* (2013.01); *B41J 2/16511* (2013.01)

(58) Field of Classification Search
None
See application file for complete search history.

(56) References Cited

U.S. PATENT DOCUMENTS

| | | | | |
|---|---|---|---|---|
| 2012/0056932 | A1 | 3/2012 | Matsubara et al. | |
| 2012/0132231 | A1 * | 5/2012 | Matsumoto et al. | 134/21 |
| 2012/0133707 | A1 | 5/2012 | Kikkawa et al. | |
| 2012/0320125 | A1 | 12/2012 | Katoh et al. | |

FOREIGN PATENT DOCUMENTS

| | | |
|---|---|---|
| JP | 6-328702 | 11/1994 |
| JP | 2000-211164 | 8/2000 |
| JP | 2007-190845 | 8/2007 |
| JP | 2010-046854 | 3/2010 |
| JP | 2013-000952 | 1/2013 |

* cited by examiner

*Primary Examiner* — Alejandro Valencia
(74) *Attorney, Agent, or Firm* — Cooper & Dunham LLP

(57) ABSTRACT

A droplet ejection device includes a recording head having a nozzle face with nozzles to eject droplets, a maintenance assembly including a cap to seal the nozzle face to form a sealed space therein and a wiper to wipe the nozzle face, a droplet suction channel connected to the cap to collect droplets sucked from the nozzles, and an air release channel connected to the cap to introduce air to return the sealed space to atmospheric pressure. The suction channel and the release channel are communicable with the sealed space to simultaneously perform collection of the droplets sucked from the nozzles and introduction of air into the cap. The suction channel has a flow rate greater than the release channel. When the droplets are sucked from the nozzles into the suction channel, air is introduced from the release channel at a flow rate lower than that of the suction channel.

9 Claims, 13 Drawing Sheets

DROPLET EJECTION DEVICE AND IMAGE FORMING APPARATUS INCLUDING THE DROPLET EJECTION DEVICE

CROSS-REFERENCE TO RELATED APPLICATIONS

This patent application is based on and claims priority pursuant to 35 U.S.C. §119 to Japanese Patent Application No. 2012-154329, filed on Jul. 10, 2012, in the Japan Patent Office, the entire disclosure of which is hereby incorporated by reference herein.

BACKGROUND

1. Technical Field

This disclosure relates to a droplet ejection device and an image forming apparatus including the droplet ejection device, and more specifically to a maintenance structure for a droplet ejection unit.

2. Description of the Related Art

Image forming apparatuses are used as printers, facsimile machines, copiers, plotters, or multifunction devices having two or more of the foregoing capabilities. As one type of image forming apparatuses, for example, inkjet recording apparatuses employing liquid ejection recording methods are known that use a recording head(s) for ejecting droplets of liquid (e.g., ink).

The inkjet recording apparatuses employing liquid ejection recording methods eject ink droplets from a recording head(s) onto a recording medium (also referred to as recording sheet), e.g., a sheet of paper, to form (record or print) images on the recording medium. Such inkjet recording apparatuses fall into two major types: a serial type in which, while the recording head moves in a main scanning direction, the recording head ejects liquid droplets to form images, and a line type in which a line-type stationary recording head ejects liquid droplets to form images.

The liquid ejection methods include, for example, the following methods

In one method, for example, a piezoelectric actuator vibrates and deforms a portion of a wall of a liquid chamber filled with ink to increase pressure in the liquid chamber to eject ink. In another method, for example, a heating element to generate heat upon energization is provided within a liquid chamber, and bubbles generated by heat of the heating element increase pressure of the liquid chamber to eject ink.

Such inkjet recording apparatuses are widely used because of advantages, for example, high speed and less noise, less constraints on the types of recording media including recording sheets of paper, and easiness of color printing.

Here, the above-described serial type and line type are further described below. The serial type of inkjet recording apparatuses typically has a carriage mounting a droplet ejection head. The carriage is serially moved for scanning in a direction perpendicular to a transport direction of a recording sheet, and the recording sheet is intermittently transported in accordance with a recording width. Thus, transport and recording (i.e., droplet ejection) can be alternately repeated.

The line type of inkjet recording apparatuses can employ a line head having droplet ejection nozzles arrayed corresponding to a whole area of one edge of the recording sheet. Unlike the serial type, the line type transports a recording sheet without moving a droplet ejection head, which is more advantageous in enhancement of the recording speed than the serial type.

Such an inkjet recording apparatus may perform maintenance and recovery operation on a recording head unit used as the above-described droplet ejection head to stabilize ink ejection from the recording head unit. In other words, by maintaining a state in which a liquid ejection face (also referred to as nozzle face) of the recording head unit is free from dried, solidified, or viscosity-increased residual ink, such an inkjet recording apparatus prevents residual ink on the nozzle face from hampering ink ejection from the recording head unit and also prevents bubbles from causing ejection failure, such as a reduced position accuracy of droplets landed on a recording medium.

Hence, for example, a nozzle-performance maintenance assembly is proposed to maintain and recover a normal state of an ink ejection performance of such a droplet ejection head. The nozzle-performance maintenance assembly has, for example, a capping function to cover the nozzle face with a moisture retention cap of a high sealing performance to prevent viscosity increase or firm adherence of ink by minimizing vaporization of ink, a discharge recovery function to discharge ejection failure factors, e.g., bubbles in nozzle orifices, by refilling and pressure feeding of recording liquid, a wiping function to wipe residual ink on the nozzle face, which may affect a flying state of liquid droplets, and a dummy ejection function to eject ink droplets to prevent drying of nozzles that are not used for image formation.

To suck ink from ejection nozzles and discharge bubbles in such a maintenance assembly, for example, a cap may have an ink collection port and an air release port connected to a suction channel and an air release channel (see, e.g., JP-2000-211164-A or JP-2007-190845-A). For example, JP-2000-211164-A describes a configuration in which a cap has an ink collection port, a suction port connected to the ink collection port and communicated with a waste liquid tank, a suction pump mounted on the suction channel, an air release channel connected to the air release port and communicated with an exterior of the cap, and an air release valve near the cap in the air release channel.

For such a configuration, maintenance and recovery operation is performed on ejection nozzles according to, for example, the following procedure.

First, the cap is brought into close contact with ejection nozzles and the air release valve is closed to seal the inside of the cap. In such a state, the suction pump is activated to suck ink or bubbles from the ejection nozzles, and the air release valve is opened to release negative pressure in the cap. In such a state, the suction pump is activated to feed ink accumulated in the cap toward the waste liquid tank.

In such a configuration as described in JP-2000-211164-A in which, by opening and closing the air release channel with the air release valve the inside of the cap is turned into negative pressure and returned to atmospheric pressure, pressure inside the cap is smoothly changed toward atmospheric pressure when the air release valve is opened. However, the inventor has recognized that, when the cap is detached from ejection nozzles, in other words, decap operation is performed with the air release valve open or ink suction is performed, ink may move into the air release channel or toward the air release valve.

In other words, when the cap having a space of negative pressure is detached from the ejection nozzles, a rapid change in pressure may wave a surface of ink in the cap, thus causing a portion of ink to move beyond the air release port into the air release channel.

If ink enters and firmly adheres in the air release channel, the channel area may be changed. In such a case, when the air release valve is opened, the flow of air may be hindered, thus hampering smooth return of the inside of the cap to atmospheric pressure when the cap is decapped from the ejection nozzles. As a result, the efficiency of collection of ink into the waste liquid tank by suction of ink may be reduced or liquid leakage may cause contamination of a surrounding area. In addition, adherence of ink on the air release valve may hamper normal operation of the air release valve. As a result, if opening and closing timings or the release amount of air is shifted, the above-described failures may arise.

Alternatively, when ejection nozzles are arrayed in a horizontal direction instead of the above-described vertical direction, the surface of ink is likely to become higher than the air release port. Hence, to prevent ink from entering the air release channel in such a configuration, for example, JP-2000-211164-A proposes a configuration in which the air release port is disposed at a position higher than a suction port in the vertical direction so that the surface of ink does not touch the air release port.

For such a configuration, however, the inventor has recognized that, as described above, if the ink surface is waved or bubbled in decap operation, the ink surface may not be stabilized, thus hampering reliable prevention of entry of ink into the air release port.

BRIEF SUMMARY

In at least one exemplary embodiment of this disclosure, there is provided a droplet ejection device including a recording head, a maintenance assembly, a droplet suction channel, and an air release channel. The recording head has a nozzle face with ejection nozzles to eject liquid droplets. The maintenance assembly maintains and recovers ejection performance of the ejection nozzles. The maintenance assembly includes a cap to seal the nozzle face of the recording bead to form a sealed space therein and a wiper to wipe the nozzle face of the recording head. The droplet suction channel is connected to the cap to collect, from the cap, liquid droplets sucked from the ejection nozzles. The air release channel is connected to the cap to introduce air into the cap to return the sealed space of the cap to atmospheric pressure. The droplet suction channel and the air release channel are communicable with the sealed space of the cap to simultaneously perform collection of the liquid droplets sucked from the ejection nozzles from the cap and introduction of air into the cap. The droplet suction channel has a flow rate greater than the air release channel. When the liquid droplets are sucked from the ejection nozzles into the droplet suction channel, air is introduced from the air release channel at a flow rate lower than the flow rate of the droplet suction channel.

In at least another exemplary embodiment of this disclosure, there is provided an image forming apparatus including the above-described droplet ejection device.

In at least still another exemplary embodiment of this disclosure, there is provided a droplet ejection device including a recording head, a maintenance assembly, a droplet suction channel, an air release channel, a first pump, and a second pump. The recording head has a nozzle face with ejection nozzles to eject liquid droplets. The maintenance assembly maintains and recovers ejection performance of the ejection nozzles. The maintenance assembly includes a cap to seal the nozzle face of the recording head to form a sealed space therein and a wiper to wipe the nozzle face of the recording head. The droplet suction channel is connected to the cap to collect, from the cap, liquid droplets sucked from the ejection nozzles. The air release channel is connected to the cap and having an air release valve to introduce air into the cap to return the sealed space of the cap to atmospheric pressure. The first pump is provided with the droplet suction channel. The second pump is provided with the air release channel. The droplet suction channel and the air release channel are formed of conduits having same cross sectional area. The first pump and the second pump are simultaneously drivable to transport fluid through the droplet suction channel and the air release channel. The air release channel is configured to have a flow rate lower than the droplet suction channel by setting a number of rotations per unit time or a driving force of the first pump greater than a number of rotations per unit time or a driving force of the second pump.

In at least further still exemplary embodiment of this disclosure, there is provided an image forming apparatus including the above-described droplet ejection device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
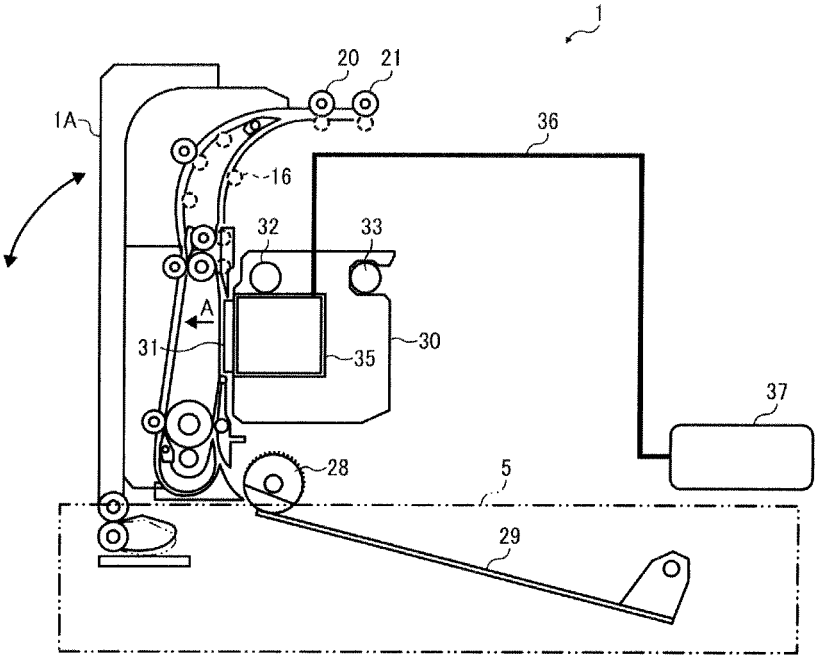
FIG. 1 is a schematic view of a configuration of an image forming apparatus using a droplet recording device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "image forming apparatus employing a liquid ejection recording method" used herein refers to an apparatus that causes liquid (e.g., ink) to land on a medium for image formation. The medium includes, for example, paper, string, fiber, cloth, leather, metal, plastic, glass, wood, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, resin, resist, chemical agent, liquid, and so on.

The term "sheet" used herein is not limited to a sheet of paper and includes anything, such as OHP (overhead projector) sheet, cloth sheet, on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below. First, an image forming apparatus according to at least one exemplary embodiment of this disclosure is described with reference to FIGS. 1 to 3.

FIG. 1 is a schematic view of an inkjet recording device 1 illustrated as an example of an image forming apparatus according to an exemplary embodiment of this disclosure.

The inkjet recording apparatus 1 has a main guide rod 32 and a sub guide rod 33 to slidably support a carriage 30. A main scanning motor and a timing belt cause the carriage 30 to move for scanning in a longitudinal direction (main scanning direction) of the main guide rod 32 and the sub guide rod 33.

The carriage 30 mounts a recording head 31 for ejecting ink droplets of different colors, e.g., yellow, cyan, magenta, and black so that ejection nozzles of the recording head 31 are arrayed in a direction perpendicular to the main scanning direction and parallel to the gravitational direction. In other words, the recording head 31 is mounted on the carriage 30 so as to eject droplets in a direction indicated by an arrow A in FIG. 1.

The recording head 31 may be a thermal-type head to obtain ejection pressure by film boiling of ink, a piezoelectric-type head to obtain ejection pressure by deforming diaphragms by piezoelectric elements, an electrostatic-type head to obtain ejection pressure by deforming diaphragms by electrostatic force, or any other suitable type.

The inkjet recording apparatus 1 conveys a recording sheet vertically upward by a sheet feed roller 28 and output milers 20 and 21. On the way of conveying the sheet, the inkjet recording apparatus 1 ejects ink droplets from the recording head 31 onto the sheet for printing. The recording head 31 is integrally connected to a sub tank 35 including an ink chamber to temporarily store ink. The term "integrally" as used herein represents that the recording head 31 is connected to the sub tank 35 via, e.g., a tube(s) or pipe(s), and both the recording head 31 and the sub tank 35 are mounted on the carriage 30.

For such a configuration in which a sheet is conveyed vertically upward, for example, if a paper jam occurs in a conveyance passage near the recording head or when servicing is performed, an operator can see a surrounding area of the recording head by opening an openable cover 1A of a body housing of the inkjet recording apparatus 1, thus facilitating servicing operation.

One end of a liquid supply tube 36 is connected to the sub tank 35 and the opposite end of the liquid supply tube 36 is connected to an ink cartridge 37 mounted on an apparatus body of the inkjet recording apparatus. In FIG. 1, the ink cartridge 37 is mounted to the apparatus body, and ink is supplied from the ink cartridge 37 to the recording head 31 via the liquid supply tube 36. It is to be noted that the configuration of liquid supply is not limited to the above-described configuration but, for example, an on-carriage system may be employed in which the ink cartridge 37 is directly mounted on the recording head 31 to perform printing.

Figure 2:
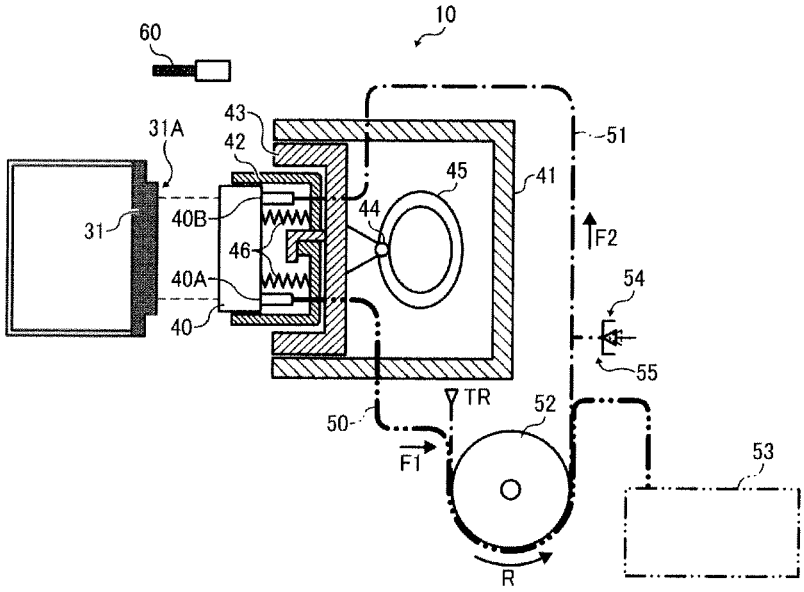
FIG. 2 is a schematic view of a maintenance assembly used in a droplet ejection device according to an exemplary embodiment of this disclosure.

FIG. 2 is a schematic view of a maintenance assembly 10 in this exemplary embodiment to maintain and recover the performance of ejection nozzles.

The maintenance assembly 10 is disposed outside an image recording area of the recording head 31. The maintenance assembly 10 has a cap 40 to contact a nozzle face 31A of the recording head 31 to seal the nozzle face 31A, thus allowing moisture retention and protection of the nozzle face 31A.

In FIG. 2, the maintenance assembly 10 has a guide 41 mounted on the apparatus body and a cap holder 42 to hold the cap 40. The cap holder 42 is slidable within the guide 41. The cap holder 42 is also movable with movement of a cap slider 43 slidable within the guide 41. The cap slider 43 has a pin 44 slidable with rotation of a cam 45 disposed in the guide 41. Sliding movement of the pin 44 in accordance with a rotational position of the cam 45 allows the cap holder 42 to slide in a direction away from the nozzle face 31A. The pin 44 engages a rail member forming the cam 45 to convert the rotation of the cam 45 into the sliding movement of the cap slider 43 and the cap holder 42.

The cap holder 42 includes springs 46 between the cap 40 and a holder bottom face opposing the cap 40, and the springs 46 urge the cap 40 in a direction to bring the cap 40 into contact with the nozzle face 31A.

Figure 3:
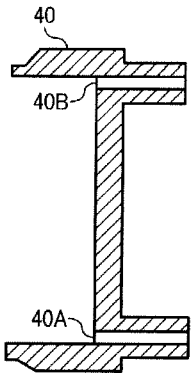
FIG. 3 is a schematic view of a configuration of a cap having ports connected to channels and usable in the maintenance assembly of FIG. 2.

For this exemplary embodiment, in the configuration in which nozzles are arrayed in the vertical direction, the cap has a box shape in a cross section having a longitudinal direction parallel to the direction in which the nozzles are arrayed. As illustrated in FIG. 3, the cap 40 has an ink suction port 40A to suck liquid, e.g., ink and an air release port 40B to introduce air from ambient atmosphere. The ink suction port 40A is disposed at a bottom face side of the cap 40, and the air release port 40B is disposed at an upper face side placed higher than a liquid level of ink in an internal space of the cap 40. As illustrated in FIG. 2, the ink suction port 40A and the air release port 40B are connected to an ink suction channel 50 and the air release channel 51, respectively.

In FIG. 2, each of the ink suction channel 50 and the air release channel 51 is at least partially formed of, e.g., a flexible tube forming a conduit. Via a single tube pump 52, the ink suction channel 50 is communicated as a channel for waste liquid with a waste liquid tank 53 and the air release channel 51 is communicated with atmosphere indicated by a blank triangle TR in FIG. 2. A wiper 60 illustrated in FIG. 2 wipes the nozzle face 31A to remove ink or foreign substance adhered on the nozzle face 31A, thus maintaining normal ink ejection performance.

For this exemplary embodiment, the flow rate is different between the ink suction channel 50 and the air release channel 51. For example, the flow rate of the ink suction channel 50 is greater than the flow rate of the air release channel 51. In other words, the flow rate of the air release channel 51 is lower than the flow rate of the ink suction channel 50.

In FIG. 2, such a difference in flow rate is set by using the ink suction channel 50 and the air release channel 51 having different diameters of conduits as indicated by different widths of lines in FIG. 2. For example, the thickness of the flexible tube of the air release channel 51 is set to be smaller than a cross-sectional area of the flexible tube of the ink suction channel 50 so that the fluid resistance (resistance against the flow of ink) of the flexible tube be greater than the flexible tube of the ink suction channel 50.

Figure 4A:
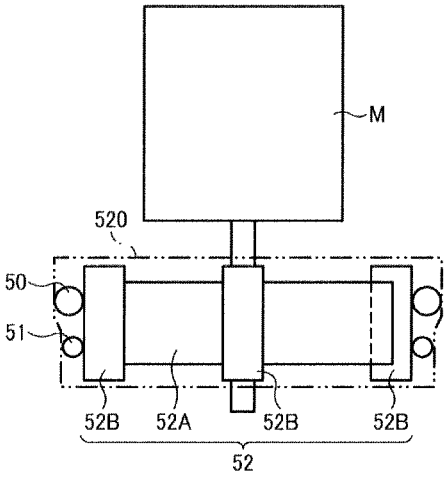
FIGS. 4A and 4B are schematic views of a tube pump and the channels used in the maintenance assembly of FIG. 2.
Figure 4B:
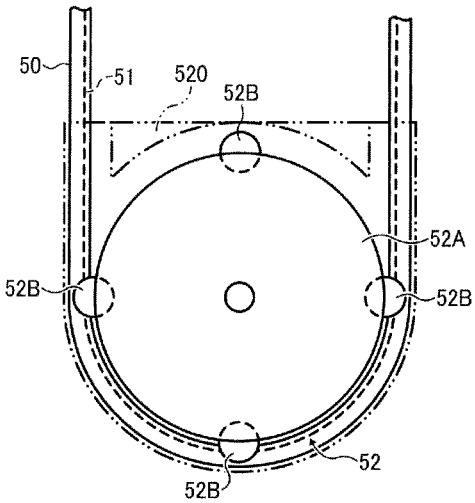

As illustrated in FIG. 4, the flexible tubes of the ink suction channel 50 and the air release channel 51 are wound around the tube pump 52, thus allowing simultaneous transport of ink and air.

The tube pump 52 includes a rotor 52A and rollers 52B. The rotor 52A is rotated by a driving motor M in a tube guide 520. The rollers 52B are disposed at positions at which an outer circumference of the rotor 52A is evenly divided. Each of the rollers 52B has an outer diameter enough to compress the flexible tube. For the tube pump 52, the rollers 52B are rotated with rotation of the rotor 52A to press the flexible tube against an internal face of the tube guide 520. As a result, while compressing and contracting the flexible tubes, a contracted position of the flexible tubes are displaced to move ink and air through the flexible tubes. In FIG. 2, arrows F1 and F2 represent the flow directions of ink and air in the ink suction channel 50 and the air release channel 51, respectively, obtained when the tube pump 52 is rotated in a direction indicated by an arrow R. In FIG. 2, the flow rates of ink and air in the ink suction channel 50 and the air release channel 51, respectively, are indicated by different lengths of the arrows F1 and F2. In other words, the arrow F1 is greater in flow rate than the arrow F2.

The tube guide 520 has a diameter of a circumference wall opposing the flexible tube so as to be able to compress the flexible tube in accordance with the outer diameter of the flexible tube of each of the ink suction channel 50 and the air release channel 51. For this exemplary embodiment, as illustrated in FIG. 4A, the tube guide 520 has a stepwise shape in which the circumference wall opposing the flexible tube of the air release channel 51 has a smaller diameter than the circumference wall opposing the flexible tube of the ink suction channel 50.

Alternatively, the flexible tubes of the ink suction channel 50 and the air release channel 51 may have the same outer diameter and different inner diameters, thus obviating the stepwise shape of the tube guide 520. Alternatively, the tube guide 520 may have the same diameter of circumference walls opposing the flexible tubes of the ink suction channel 50 and the air release channel 51. In such a case, the rollers 52B have a stepwise shape as described above.

In FIG. 2, a portion of the air release channel 51 extended from the guide 41 merges with a channel connected to an air release valve 54. The channel and the air release valve 54 form an air introduction unit 55. For the air release channel 51, when the tube pump 52 is operated (rotated) with the air release valve 54 closed, the internal pressure of the cap 40 turns into negative pressure, thus introducing atmospheric air from the terminal TR. When the tube pump 52 is stopped and the air release valve 54 is opened, the inside of the cap 40 is communicated with the atmosphere. As a result, when the cap 40 is detached from the nozzle face 31A with the tube pump 52 stopped, even without transport of atmospheric air by rotation of the tube pump 52, air is promptly introduced from the air release valve 54 to the air release port 40B, thus allowing quick return of the inside of the cap 40 to atmospheric pressure.

Next, cap and decap states of the cap 40 in this exemplary embodiment are described below with reference to FIGS. 5A, 5B, 6A and 6.

Figure 5A:
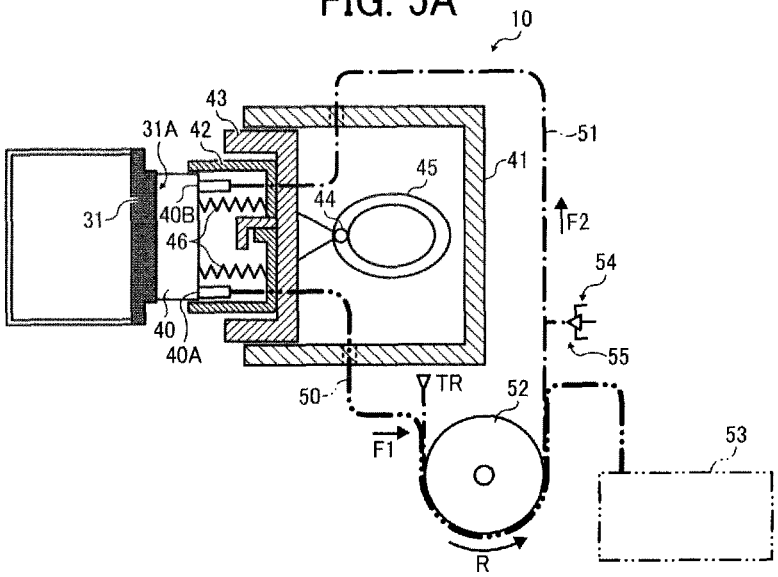
FIG. 5A is a schematic view of a state of the maintenance assembly of FIG. 2.

FIG. 5A shows a state in which the cap 40 is in close contact with the nozzle face 31A of the recording head 31 and the air release valve 54 is closed. In such a state, when the tube pump 52 is rotated, air is introduced from the inside of the cap 40 to the ink suction channel 50. As a result, air is introduced into the air release channel 51 toward the cap 40. At this time, the flow rate is different between the ink suction channel 50 and the air release channel 51. The inside of the cap 40 is likely to have negative pressure due to a difference in the flow rate caused by setting the flow rate in the ink suction channel 50 to be greater than the flow rate of the air release channel 51. As a result, ink or bubble in ejection nozzles is sucked into the cap 40, further introduced from the inside of the cap 40 into the ink suction channel 50 via the tube pump 52, and discharged into the waste liquid tank 53.

Meanwhile, air is continuously introduced into the air release port 40B of the cap 40 communicated with the air release channel 51 at a flow rate lower than that in the ink suction channel 50, thus preventing ink, including foamed ink, from being introducing into the air release port 40B. Such a configuration prevents ink adherence in the air release channel 51 that may be caused when ink is introduced from the air release port 40B into the air release port 40B or ink adherence in the air release valve 54. Thus, normal operation of the air release valve 54 is maintained without hampering the flow of air.

Figure 5B:
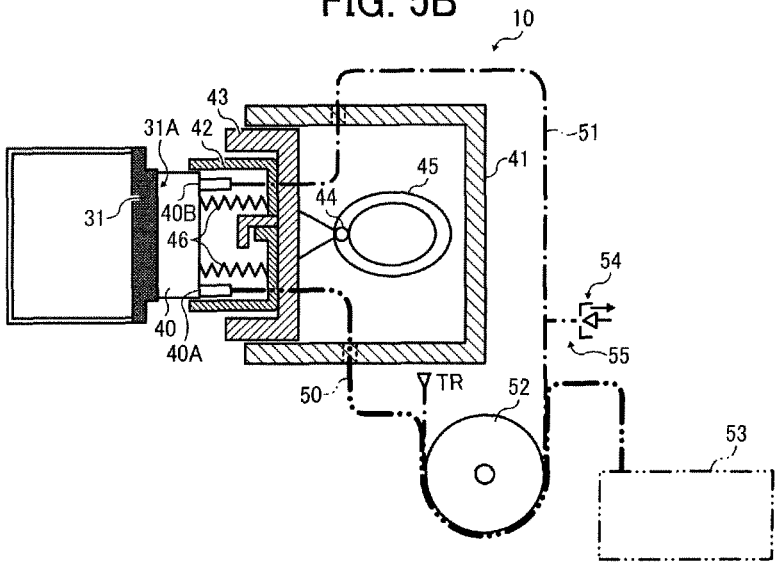
FIG. 5B is a schematic view of another state of the maintenance assembly of FIG. 2.

By contrast, FIG. 5B shows a state in which the tube pump 52 is stopped. In this state, the air release valve 54 is opened. As a result, when the inside of the cap 40 has a negative pressure, ambient air is introduced into the air release port 40B due to the negative pressure, thus returning the inside of the cap 40 to the atmospheric pressure. In this state, as in the case of FIG. 5A, introduction of ambient air into the air release port 40B prevents ink from being introduced from the inside of the cap 40 into the air release port 40B.

Figure 6A:
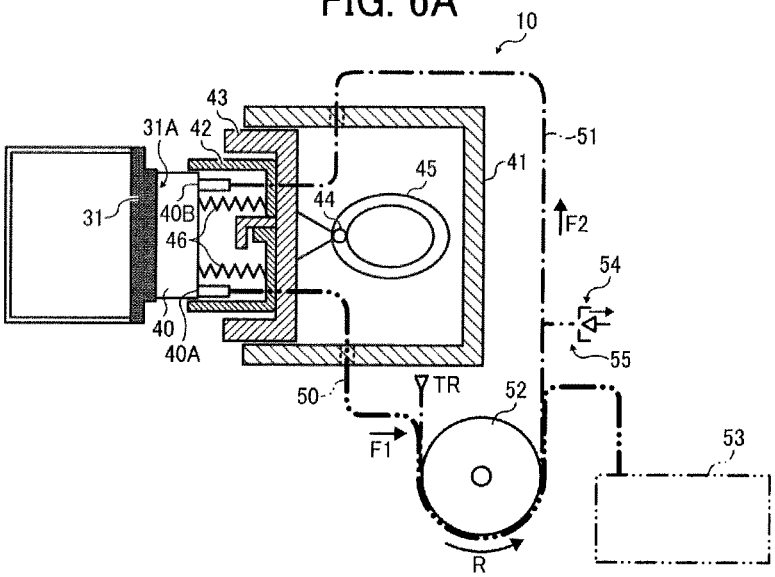
FIG. 6A is a schematic view of a state of the maintenance assembly of FIG. 2 changed from the state illustrated in FIG. 5B.
Figure 6B:
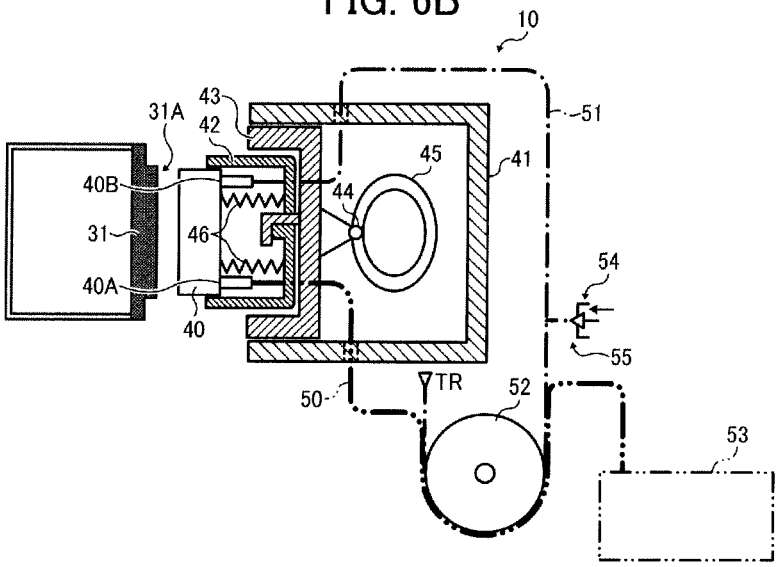
FIG. 6B is a schematic view of a decap state of the maintenance assembly of FIG. 2.

FIGS. 6A and 6B show a preliminary stage of decapping and a flow state in decapping, respectively. FIG. 6A shows a state in which the tube pump 52 is driven from the open state of the air release valve 54 illustrated in FIG. 5B. In the state of FIG. 6A, when air is introduced from the air release valve 54 into the cap 40 and ink or air in the cap 40 is introduced into the waste liquid tank 53, the inside of the cap 40 is emptied. While the state of FIG. 6A is maintained, ambient air is continuously introduced into the air release port 40B, thus preventing ink from being introduced into the air release channel 51.

FIG. 6B shows a decap state in which the cap 40 is decapped from the nozzle face 31A. In the state of FIG. 6B, the tube pump 52 is stopped and the cam 45 is rotated. As a result, the cap holder 42 is slid with the cap slider 43 in a direction away from the nozzle face 31A.

By rotation of the tube pump 52 at the precedent step, residual ink or bubbles inside the cap 40 are transported to the waste liquid tank 53, and the inside of the cap 40 is emptied. In addition, air introduced from the air release channel 51 returns the inside of the cap 40 to the atmospheric pressure. Such a configuration allows smooth separation of the cap 40 from the nozzle face 31A and prevents suction of ink from the ejection nozzles due to negative pressure, thus preventing inadvertent dripping of ink.

For the above-described exemplary embodiment, the flow rate is different between the ink suction channel 50 and the air release channel 51, and the ink suction channel 50 and the air release channel 51 are driven by the single tube pump 52. Such a configuration can simplify the configuration of the driving unit (in this exemplary embodiment, the tube pump 52) for creating negative pressure inside the cap 40 and returning the inside of the cap 40 to atmospheric pressure. In addition, for the above-described exemplary embodiment, different flow rates are set between the ink suction channel 50 and the air release channel 51 and ambient air is introduced from the air release channel 51. When ink or bubbles are sucked from the ink suction channel 50, such a configuration can continuously prevent ink from being introduced into the air release channel 51.

Next, another exemplary embodiment of this disclosure is described with reference to FIG. 7.

In this exemplary embodiment, an ink suction channel 50' and an air release channel 51' have the same cross-sectional area, and the flow rate of the ink suction channel 50' is lower than the flow rate of the air release channel 51'.

Figure 7:
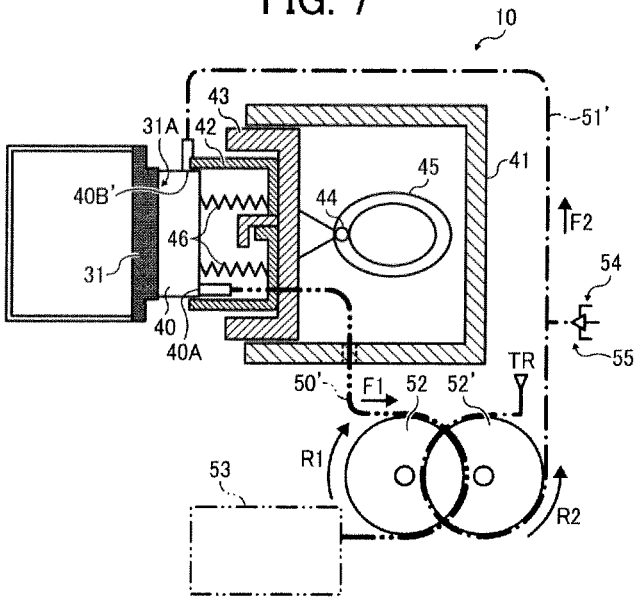
FIG. 7 is a schematic view of a configuration of another example of a maintenance assembly usable in a droplet ejection device according to an exemplary embodiment of this disclosure.

FIG. 7 is a schematic view of another example of a maintenance assembly 10 usable in a droplet ejection device according to an exemplary embodiment of this disclosure.

Figure 8:
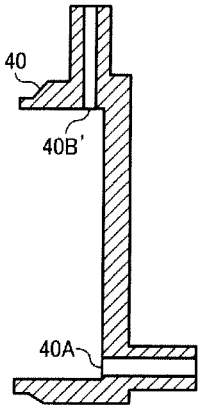
FIG. 8 is a cross sectional view of a configuration of a cap having ports connected to channels and usable in the maintenance assembly illustrated in FIG. 7.

In FIG. 7, a cap 40 has an air release port 40B' connected to the air release channel 51', the air release port 40B' is disposed in an upright state on an upper face of the cap 40. FIG. 8 is a cross sectional view of a configuration of an ink suction port 40A and the air release port 40B'. As illustrated in FIG. 8, the air release port 40B' is disposed on the upper face of the cap 40. As a result, an opening face of the air release port 40B' is faced down, thus facilitating air to stop around an opening of the air release port 40B' due to the characteristics that air is likely to rise. As a result, the air release port 40B' is less likely to be touched with the liquid level of ink. Such a configuration can also effectively prevent ink from adhering around the air release port 40B'.

Figure 9A:
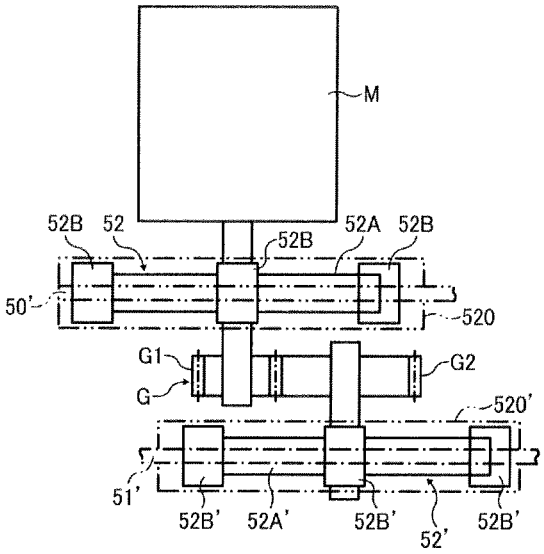
FIGS. 9A and 9B are schematic views of a tube pump and the channels used in the maintenance assembly of FIG. 7.
Figure 9B:
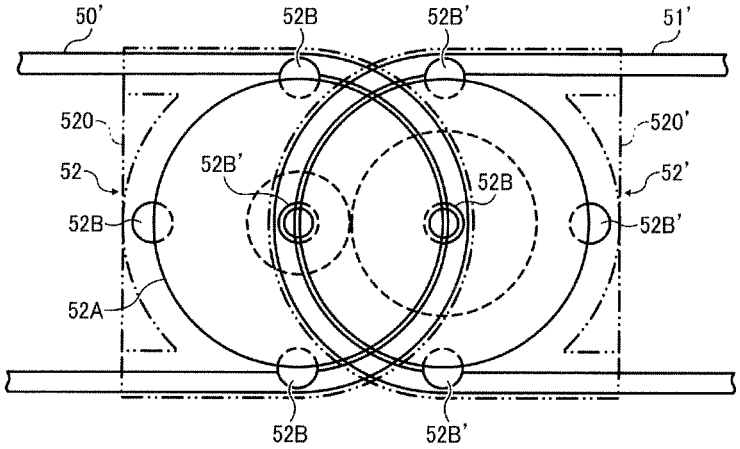

In FIGS. 9A and 9B, two tube pumps 52 and 52' are provided so that flexible tubes of the ink suction channel 50' and the air release channel 51' are wound around the tube pumps 52 and 52'. In FIGS. 9A and 9B, of the tube pumps 52 and 52', the tube pump 52 for the flexible tube of the ink suction channel 50' is mounted on an output shaft of a single driving motor M. The tube pump 52' is movable with the tube pump 52 via a deceleration gear set G. In other words, the deceleration gear set G includes a driving gear G1 and a driven gear G2. The gear G1 is coaxially mounted on a rotation shaft of the tube pump 52. The driven gear G2 has a deceleration ratio relative to the driving gear G so that the driven roller G2 is rotated at a lower speed than the driving gear G1. The deceleration gear set G has a deceleration ratio so that the tube pump 52' for the air release channel 51' is rotated at a lower speed than the tube pump 52 for the ink suction channel 50'. In FIGS. 9A and 9B, components of the tube pump 52' for the air release channel S1' are indicated by prime code.

As described above, the tube pump 52' for the air release channel 51' is rotated at a lower rotation speed than the tube pump 52 for the ink suction channel 50'. Hence, the flow rate of the air release channel 51' is set to be lower than the flow rate of the ink suction channel 50'. Alternatively, instead of the relationship of rotation speed, for example, the flexible tubes of the ink suction channel 50' and the air release channel 51' have different degrees of rigidity against deformation. In such a case, by setting different driving forces between the tube pumps 52 and 52', the flow rate of the air release channel 51' is set to be lower than the flow rate of the ink suction channel 50'.

The deceleration gear set G has a one-step gear engagement structure, and the tube pumps 52 and 52' are rotated in opposite directions. When the tube pump 52 for the ink suction channel 50' is rotated to turn the inside of the cap 40 into negative pressure, the tube pump 52' for the air release channel 51' is rotated in reverse relative to the tube pump 52 for the ink suction channel 50' via the deceleration gear set G. For such a configuration, as indicated by an arrow R1 in FIG. 7, when the tube pump 52 for the ink suction channel 50' is rotated in a direction to turn the inside of the cap 40 into negative pressure, the tube pump 52' for the air release channel 51' is rotated in a direction to introduce atmospheric air into the cap 40 as indicated by an arrow R2.

For the above-described configuration, the tube pumps 52 and 52' are set so as to simultaneously rotate. As a result, when ink or bubbles are sucked from ejection nozzles with the cap 40 being in close contact with the nozzle face 31A, air is introduced into the cap 40 via the air release channel 51' at a lower flow rate than that of the ink suction channel 50'. As a result, as in the above-described exemplary embodiment, the inside of the cap 40 is turned into negative pressure due to the difference in flow rate between the ink suction channel 50' and the air release channel 51', and atmospheric air is continuously introduced from the air release port 40B', thus preventing ink from being introduced into the air release port 40B'.

The air release port 40B' has a downward opening face, and as described above, introduction of ambient air allows maintenance of a separation state of ink from the opening face, thus preventing ink from being introduced into the air release port 40B'.

By contrast, for the configuration illustrated in FIG. 7, the procedure of capping and decapping performed by rotation and stopping of the air release valve 54 and the tube pumps 52 and 52' is the same as that of the above-described exemplary embodiment.

Next, a variation of the air release port 40B' is described below.

Figure 10:
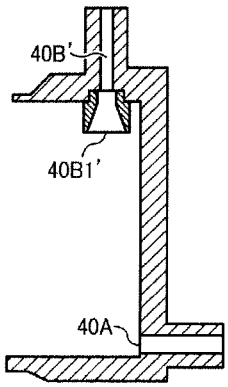
FIG. 10 is a schematic view of another example of a cap having ports connected to channels and usable in the maintenance assembly illustrated in FIG. 7.

FIG. 10 shows a configuration of the air release port 40B' disposed at an upper face of the cap 40. In FIG. 10, the air release port 40B' is integrally provided with a hood member 40B1' at the opening face side. The hood member 40B1' has an opening of a larger diameter than an opening of the air release port 40B'.

For such a configuration, the air release port 40B' is covered with the hood member 40B', and an open face of the hood member 40B1' has a larger diameter than the air release port 40B'. As a result, a relatively large amount of air is accumulated within the opening face of the hood member 40B1' by buoyancy of atmospheric air introduced into the cap 40. As a result, a blocking layer of air is formed to block the air release port 40B' from the opening face of the hood member 40B1', thus preventing ink from entering the air release port 40B'.

When the liquid level of ink sucked into the cap 40 reaches a lower end of the hood member 40B1', such a larger diameter of the opening of the hood member 40B1' can prevent ink from entering the air release port 40B by a moon-shaped ink surface formed at a lower face of meniscus and fixing at the air release port 40B'.

Next, another exemplary embodiment of this disclosure is described below.

Figure 11:
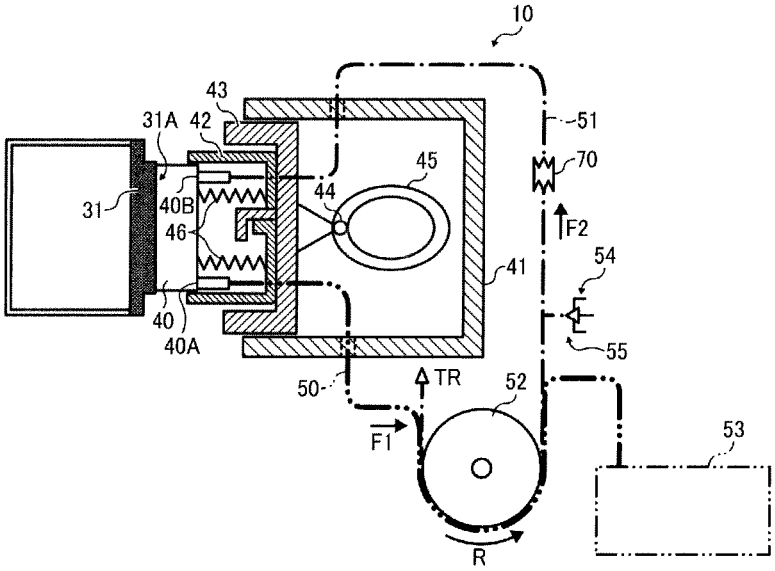
FIG. 11 is a schematic view of still another example of a maintenance assembly usable in a droplet ejection device according to an exemplary embodiment of this disclosure.

FIG. 11 is a schematic view of a configuration of another example of a maintenance assembly usable in a droplet ejection device according to another exemplary embodiment of this disclosure. For a configuration of FIG. 11, like the configuration of FIG. 2, an air release channel 51 has a smaller channel area than an ink suction channel 50 and the flow rate of the air release channel 51 is lower than the flow rate of the ink suction channel 50. For the configuration of FIG. 11, additionally, an air accumulator 70 is disposed at a position more proximal relative to the cap 40 than the air release valve 54 relative to the cap 40 in the air release channel 51.

In FIG. 11, the air accumulator 70 is formed with a shape restorable member, e.g., a deformable accordion member including an expandable and contractible space communicated with the air release channel 51. When air flown through the air release channel 51 is accumulated in the air accumulator 70, the air accumulator 70 is expanded. As a result, the air release channel 51 communicated with the cap 40 is turned into negative pressure, and the air accumulator 70 is contracted. Thus, air accumulated in the air accumulator 70 is discharged into the air release channel 51. Even when the air accumulator 70 is contracted, a communicated state of the air release port 40B with the air release valve 54 is secured by a flow channel in the air accumulator 70. As a result, until the air accumulator 70 is fully compressed, air discharged from the air accumulating portion 70 flows through the air release channel 51 at a flow rate substantially equivalent to a flow rate of ink flowing through the ink suction channel 50.

FIGS. 12A and 12B and 13A and 13B are schematic views showing operation states of the droplet ejection device of FIG. 11.

Figure 12A:
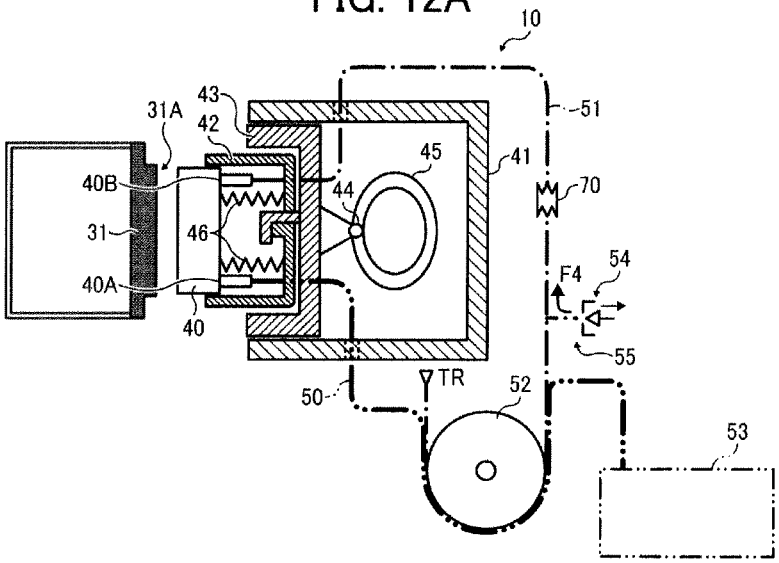
FIG. 12A is a schematic view of a state of the maintenance assembly of FIG. 11 before maintenance operation.
Figure 12B:
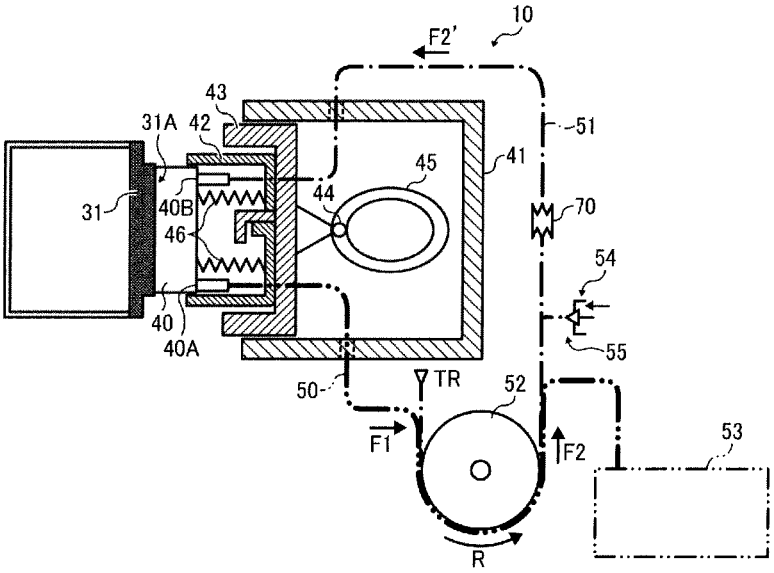
FIG. 12B is a schematic view of a capping state of the maintenance assembly of FIG. 11.

FIG. 12A is a state of the droplet ejection device before recovery operation. FIG. 12B is a state of the droplet ejection device in which the cap 40 is in close contact with the nozzle face 31A to start the recovery operation. As illustrated in FIG. 12A, before the cap 40 is brought into close contact with the nozzle face 31A, the air release channel 51 is communicated with the atmosphere via the air release valve 54. As a result, the air accumulator 70 is expanded by a force of restoring its shape to accumulate air therein.

By contrast, as illustrated in FIG. 12B, when recovery operation is started and the cap 40 is brought into close contact with the nozzle face 31A, the tube pump 52 is rotated, thus creating flows indicated by arrows F1 and F2 in the ink suction channel 50 and the air release channel 51, respectively. By contrast, when the tube pump 52 starts rotation, an air flow is created in the ink suction channel 50 to turn the inside of the cap 40 into negative pressure. Meanwhile, an air flow (indicated by an arrow F2' in FIG. 12B) is created in the air release channel 51 to flow in a direction from the a air accumulator 70 to the cap 40. As in the case of FIG. 2, the flow rate of the air release channel 51 is lower than the flow rate of the ink suction channel 50. As a result, the difference in flow rate between the ink suction channel 50 and the air release channel 51 turns the inside of the cap 40 into negative pressure. Such negative pressure causes air to be introduced from the air accumulator 70 to the cap 40.

Figure 13A:
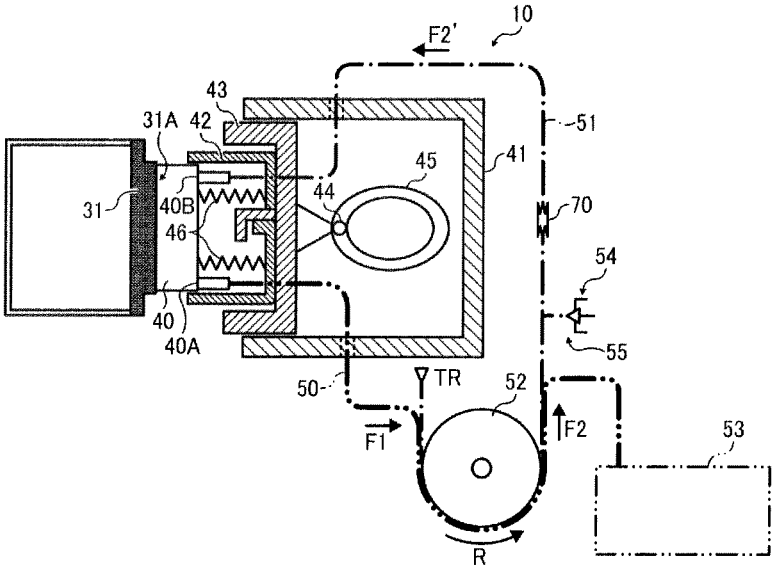
FIG. 13A is a schematic view of a state of the maintenance assembly of FIG. 11 changed from the state illustrated in FIG. 12B.

When air is discharged from the air accumulator 70 due to such negative pressure created by the difference in flow rate between the ink suction channel 50 and the air release channel 51A, as illustrated in FIG. 13A, the air accumulator 70 is likely to be compressed. As a result, when the air accumulator 70 is compressed, negative pressure in the cap 40 is increased. Such an increased negative pressure allows ink or bubbles to be sucked from nozzles of the recording head 31 to the cap 40.

When ink or bubbles are sucked from nozzles of the recording head 31, the air accumulator 70 is compressed. However, even in such a compressed state, the flow channel is maintained in the air accumulator 70 to secure the communicated state of the air release port 40B with the air release valve 54, thus allowing air having passed the tube pump 52 to be continuously introduced into the cap 40. As a result, when ink or bubbles are sucked, introduction of air from the air release port 40B prevents ink from entering the air release port 40B.

Figure 13B:
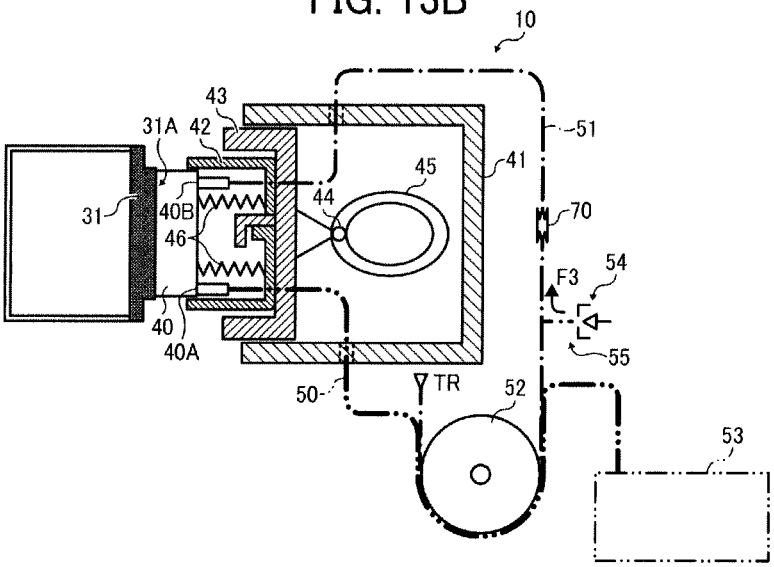
FIG. 13B is a schematic view of another state of the maintenance assembly of FIG. 11.

When suction of ink or bubbles from the nozzles of the recording head 31 is finished, the tube pump 52 is stopped. When the tube pump 52 is stopped, as illustrated in FIG. 13B, the air release valve 54 is opened to introduce atmospheric air (as indicated by an arrow F3 in FIG. 13B).

Figure 14A:
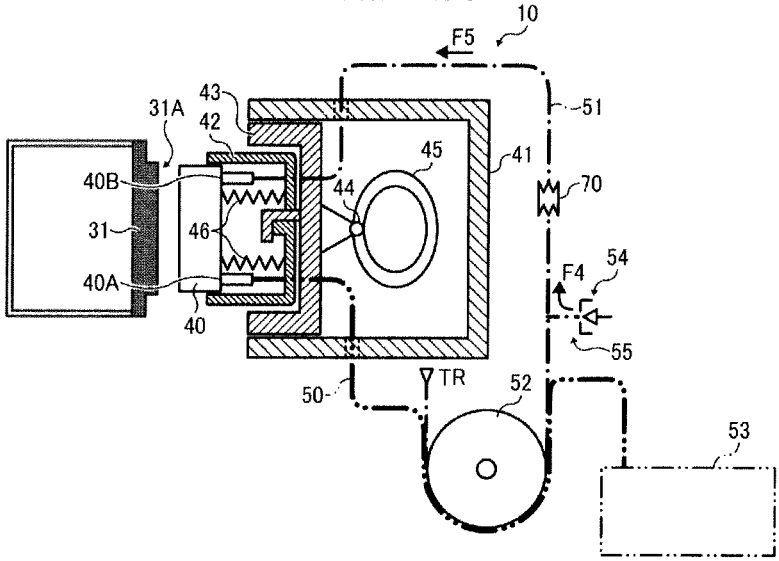
FIG. 14A is a schematic view of a state of the maintenance assembly of FIG. 11 changed from the state illustrated in FIG. 13B.

When the air release valve 54 is opened, as illustrated in FIG. 14A, the air accumulator 70 introduces air by the shape restoring force to restore its original shape, thus accumulating atmospheric air therein. When atmospheric air is introduced into the air accumulator 70, the inside of the cap 40 is returned to atmospheric pressure via the air release channel 51. At this time, since the flow rate of the air release channel 51 (indicated by an arrow F5 in FIG. 17A) is lower than the flow rate of the ink suction channel 50 (indicated by an arrow F4), the inside of the cap 40 is gradually, rather than rapidly, returned to atmospheric pressure. If the internal pressure of the cap 40 is rapidly changed, for example, rapidly returned from negative pressure to atmospheric pressure, air might be mixed into the ejection nozzles. However, the above-described configuration of this exemplary embodiment prevents mixing of air into the ejection nozzles that might be caused by such a rapid pressure change in the cap 40. In addition, the above-described configuration of this exemplary embodiment prevents ink from sucking and dripping from ejection nozzles when the cap 40 is detached from the recording head 31.

Figure 14B:
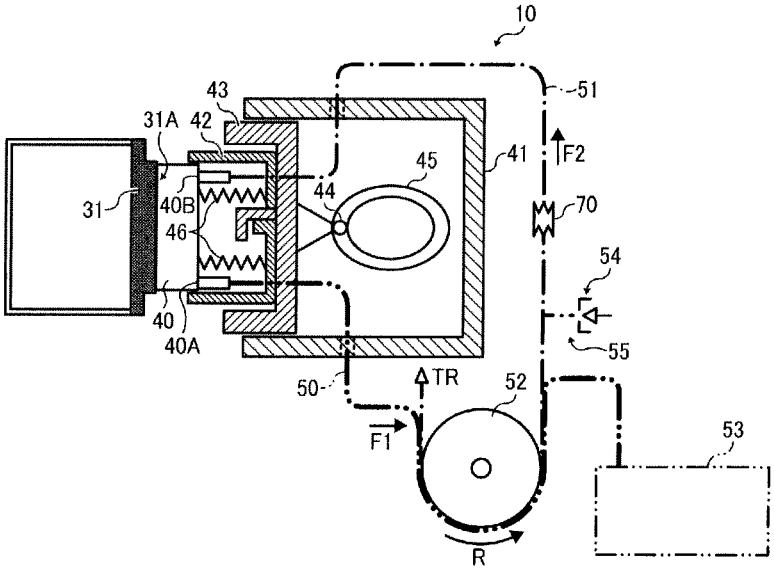
FIG. 14B is a schematic view of a state of the maintenance assembly of FIG. 11 in which the inside of a cap is returned to atmospheric air.

FIG. 14B is a state after the inside of the cap 40 is returned to atmospheric pressure. In such a state illustrated in FIG. 14B, rotation of the tube pump 52 is started again. As in the case illustrated in FIG. 13A, rotation of the tube pump 52 causes atmospheric air to be introduced from the air accumulator 70 to the cap 40. Meanwhile, ink or air is sucked from the ink suction channel 50 and ink is collected into a waste liquid tank 53. As a result, ink accumulated in the cap 40 is removed. Then, the cap 40 is detached from the nozzle face 31A, and a wiper 60 wipes the nozzle face 31A. Thus, the droplet ejection device is returned to the state illustrated in FIG. 12A, and a series of maintenance and recovery operation is finished.

For this exemplary embodiment, before ink or bubbles are sucked from ejection nozzles, atmospheric air can be introduced from the air release port 40B of the cap 40. In other words, when rotation of the tube pump 52 is started, the inside of the cap 40 is turned into negative pressure via the ink suction channel 50. In response to such a negative pressure state, air is introduced from the air accumulator 70 to the cap 40. As a result, air is continuously present in the air release port 40B of the cap 40, thus preventing entry of ink into the air release port 40B which might be caused when ink or bubbles suction is started. For example, after the air accumulator 70 is compressed, the negative pressure in the cap 40 increases. Hence, the above-described configuration of this exemplary embodiment allows setting of a procedure in which ink suction is started when and after the air accumulator 70 is compressed, thus securely preventing ink from being introduced into or adhered to the air release port 40B.

Next, a variation of the maintenance assembly according to the above-described exemplary embodiment is described below.

Figure 15:
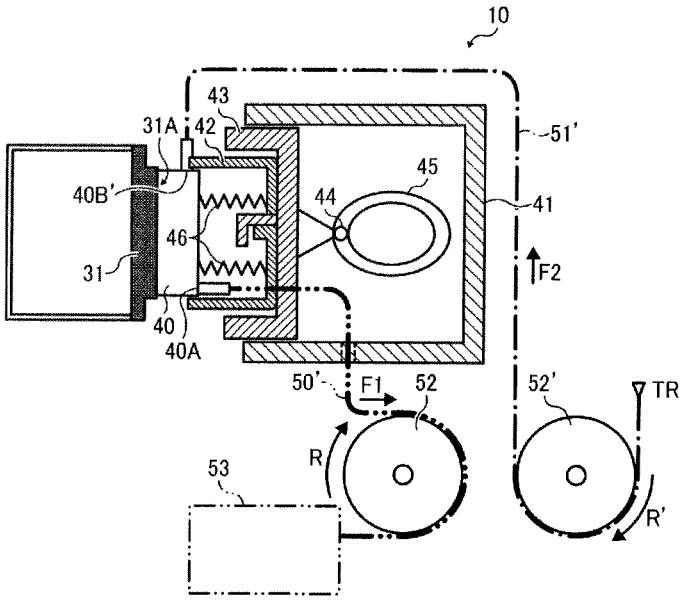
FIG. 15 is a schematic view of a variation of the maintenance assembly of FIG. 7.

FIG. 15 is a variation of the configuration illustrated in FIG. 7. In FIG. 15, tube pumps 52 and 52' corresponding to the ink suction channel 50 and the air release channel 51, respectively, are provided independent of each other. The air release valve 54 of FIG. 7 is omitted from the configuration illustrated in FIG. 15.

In the configuration of FIG. 15, driving sources to drive the tube pumps 52 and 52' are separately provided. Driving conditions of the driving sources includes, for example, a condition in which the flow rate of the air release channel 51 can be set to be lower than the flow rate of the ink suction channel 50 and a condition in which driving of the tube pump 52' for the air release channel 51 is started simultaneously with or earlier than driving of the tube pump 52 for the ink suction channel 50.

For the above-described configuration, when sucking operation is started with the cap 40 being in close contact with the nozzle face 31A, the tube pumps 52 and 52' are simultaneously rotated, and air is continuously introduced from the air release port 40B during sucking operation. As a result, such an air blow from the air release port 40B prevents ink from being introduced into or adhered to the air release port 40B.

By contrast, when rotation of the tube pump 52' for the air release channel 51 is started before rotation of the tube pump 52 for the ink suction channel 50, air is introduced from the air release port 40B before start of sucking operation. As a result, as in the above-described case, air is introduced from the air release port 40B, in other words, air is blown from the air release port 40B, thus preventing, in advance, ink from being introduced into or adhered to the air release port 40B when sucking operation of ink or bubbles is started.

For the above-described configuration, an air release valve is not used. Hence, during stop of sucking operation, the tube pump 52 for the ink suction channel 50 is stopped before the tube pump 52' for the air release channel 51. As a result, air is introduced into the cap 40 via the tube pump 52' for the air release channel 51, thus returning the inside of the cap 40 to atmospheric pressure. After such operation, the tube pumps 52 and 52' are rotated again in a condition in which the flow rates of the tube pumps 52 and 52' are equivalent. As a result, ink is collected from the cap 40, and the cap 40 is detached from the nozzle face 31A.

For such a configuration, each of the tube pumps 52 and 52' are targeted for a single driven member (the ink suction channel 50 or the air release channel 51), thus providing a simple configuration. In addition, setting of driving conditions of each driving source can obviate the air release valve, thus providing a simpler configuration.

For the above-described exemplary embodiment, the tube pump(s) is used. It is to be noted that the type of pump is not limited to such a tube pump but, for example, a diaphragm pump or any other suitable type of pump may be used. In a case in which the diaphragm pump is used, the size or flow rate of a diaphragm for the air release channel can be set to be smaller than a diaphragm for the ink suction channel. For such a configuration, a single common motor can turn the inside of the cap 40 into negative pressure due to the difference in flow rate while feeding air to the air release port. However, the tube pump has an advantage that, during stop of the tube pump, the ink suction channel or the air release channel can be reliably closed. In such a sense, the tube pump is preferable.

Next, an example in which the configuration of the above-described exemplary embodiment is applied to ejection nozzles is described below. For the above-described exemplary embodiment, ejection nozzles are arrayed in a vertical direction. It is to be noted that the direction in which ejection nozzles are arrayed is not limited to the vertical direction but, for example, may be a horizontal direction. In such a case in which ejection nozzles are arrayed in the horizontal direction, ink is ejected in the vertical direction.

Figure 16:
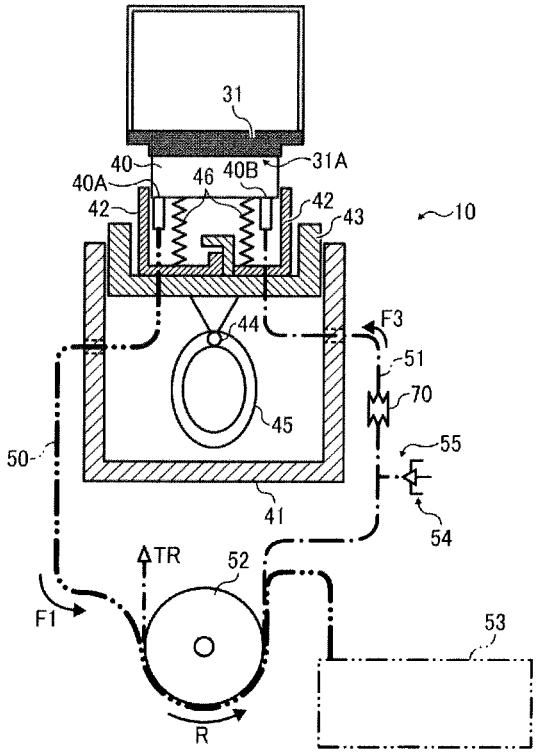
FIG. 16 is a schematic view of a variation of the maintenance assembly of FIG. 11.
Figure 17:
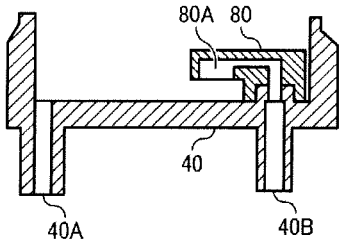
FIG. 17 is a schematic view of a variation of a cap usable in the variation illustrated in FIG. 16.

FIGS. 16 and 17 show the latter case, i.e., the configuration in which ejection nozzles are arrayed in the horizontal direction. FIG. 16 shows a case in which, in the configuration illustrated in FIG. 11, the cap 40 is disposed opposing the ejection nozzles arrayed in the horizontal direction.

A droplet ejection device illustrated in FIG. 16 has an air release port of a cap differing from the above-described exemplary embodiments and their variations. FIG. 17 is a schematic view of the cap 40A. In FIG. 17, at a bottom face of the cap 40 disposed in the horizontal direction, an opening of an ink suction port 40A is disposed at one end and an air release port 40B is disposed at the opposite end.

The air release port 40B is provided with a hood member 80 having a curved channel 80A. The curved channel 80A has a downward opening face that is turned downward from an upward opening face proximal to the air release channel 51 so as to oppose the bottom face of the cap 40. The hood member 80 is mounted on the air release port 40B so as to cover the air release port 40B, and air is introduced from the downward opening face into the cap 40.

For such a configuration of the air release port 40B, air introduced downward the hood member 80 can be accumulated by buoyancy near the downward opening face of the hood member 80. Therefore, when ink or bubbles are sucked from nozzles, such accumulation of air near the downward opening face can prevent ink, including, e.g., foamed ink blocking ink from the opening face, from entering or adhering in the air release port 40B.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A droplet ejection device, comprising:

a recording head having a nozzle face with ejection nozzles to eject liquid droplets;

a maintenance assembly to maintain and recover ejection performance of the ejection nozzles, the maintenance assembly including a cap to seal the nozzle face of the recording head to form a sealed space therein and a wiper to wipe the nozzle face of the recording head;

a droplet suction channel connected to the cap to collect, from the cap, liquid droplets sucked from the ejection nozzles;

a tube pump; and an air release channel connected to the cap to introduce air into the cap to return the sealed space of the cap to atmospheric pressure, wherein the air release channel includes an air introduction port at an end of the air release channel and disposed upstream of the tube pump, an air release valve connected to another channel branched from the air release channel at a position downstream from the tube pump in the air release channel, and an air release port at another end of the air release channel and disposed downstream of said position at which said another channel is branched from the air release channel, wherein the droplet suction channel and the air release channel are communicable with the sealed space of the cap to simultaneously perform collection of the liquid droplets sucked from the ejection nozzles from the cap and introduction of air into the cap, the droplet suction channel has a flow rate greater than the air release channel, and when the liquid droplets are sucked from the ejection nozzles into the droplet suction channel, air is introduced from the air release channel at a flow rate lower than the flow rate of the droplet suction channel, and wherein when the tube pump is in operation and the air release valve is closed, air is introduced into an inside of the cap via the air introduction port, the air release channel and the air release port, and when the tube pump is stopped and the air release valve is opened, an interior of the cap is communicated with ambient atmosphere.

2. The droplet ejection device of claim 1, wherein the droplet suction channel is at least partially formed of a first flexible tube and the air release channel is at least partially formed of a second flexible tube, the tube pump is driven to extend and contract the first flexible tube and the second flexible tube to transport liquid droplets and air, and the second flexible tube of the air release channel has a smaller inner diameter than the first flexible tube of the droplet suction channel.

3. The droplet ejection device of claim 1, further comprising an air introduction unit connected to the air release channel, wherein the air release channel has a first end and a second end opposite the first end in an extension direction thereof, the first end and the second end are connected to the cap and the tube pump, respectively, to be communicated with ambient atmosphere via the tube pump, the air introduction unit is connected to the air release channel at a position between the first end and the second end of the air release channel in the extension direction, and the air introduction unit has an air release valve openable to return the sealed space of the cap to the atmospheric pressure.

4. The droplet ejection device of claim 3, wherein, when, after the cap closes the nozzle face of the recording head, the introduction of air into the cap is performed simultaneously with or before the collection of the liquid droplets sucked from the ejection nozzles from the cap, the sealed space of the cap is turned into negative pressure due to a difference in flow rate between the droplet suction channel and the air release channel to suck liquid droplets or air, and after the air release valve is opened, the cap is detached from the nozzle face.

5. The droplet ejection device of claim 1, wherein the air release channel has an air accumulator disposed at a position more proximal relative to the cap than the air release valve relative to the cap, and the air accumulator is configured to accumulate air flowing through the air release channel and, as the sealed space of the cap is turned into negative pressure, feed accumulated air to the sealed space of the cap.

6. The droplet ejection device of claim 1, wherein, when the ejection nozzles are arrayed in a vertical direction, the droplet suction channel connected to the cap is disposed at a lower side of the sealed space of the cap, the air release channel is disposed higher than the droplet suction channel, and at or before start of suction of the liquid droplets from the ejection nozzles, atmospheric air is introduced from the air release channel at a flow rate lower than the flow rate of the droplet suction channel.

7. The droplet ejection device of claim 6, wherein the cap has a connecting portion to connect the sealed space and the air release channel, the connecting portion has a downward opening, and the air release channel has an opening of a cross sectional area greater than a cross sectional area of a channel of the connecting portion.

8. The droplet ejection device of claim 1, wherein, when the ejection nozzles are arrayed in a horizontal direction, the droplet suction channel and the air release channel are disposed at a bottom face side of the cap, the cap has a connecting portion to connect the sealed space of the cap to the air release channel and a hood member mounted on the connected portion to cover the connected portion, the hood member includes a curved channel and a downward opening communicated with the connecting portion via the curved channel, at or before start of suction of the liquid droplets from the ejection nozzles, atmospheric air is introduced from the air release channel at a flow a e lower than the flow rate of the droplet suction channel.

9. An image forming apparatus, comprising a droplet ejection device according to claim 1.

* * * * *